US005963239A

United States Patent [19]

Nishioka et al.

[11] Patent Number: 5,963,239

[45] Date of Patent: Oct. 5, 1999

[54] INK JET RECORDING APPARATUS AND INK SUPPLY MEMBER THEREFOR

[75] Inventors: Atsushi Nishioka; Yukihiro Hanaoka; Kazuhiko Sato; Tsutomu Yamazaki, all of Suwa, Japan

[73] Assignee: Seiko Epson Corporation, Tokyo, Japan

[21] Appl. No.: 08/816,101

[22] Filed: Mar. 14, 1997

[30] Foreign Application Priority Data

Mar. 14, 1996 [JP] Japan ..... 8-057938
Mar. 12, 1997 [JP] Japan ..... 9-057865

[51] Int. Cl.[6] ..... B41J 2/19

[52] U.S. Cl. ..... 347/92

[58] Field of Search ..... 347/92, 93, 85, 347/86

[56] References Cited

U.S. PATENT DOCUMENTS

| | | | |
|---|---|---|---|
| 4,301,459 | 11/1981 | Isayama et al. | 347/92 |
| 4,537,680 | 8/1985 | Barth . | |
| 4,593,296 | 6/1986 | Dagna . | |
| 4,967,209 | 10/1990 | Hasegawa et al. . | |
| 5,457,485 | 10/1995 | Moriyama et al. | 347/92 |

FOREIGN PATENT DOCUMENTS

| | | | |
|---|---|---|---|
| 0 518 380 | 12/1992 | European Pat. Off. . | |
| 0 661 160 | 7/1995 | European Pat. Off. . | |
| 661 160 | 7/1995 | European Pat. Off. . | |
| 37 32 395 | 4/1989 | Germany . | |
| 62-59671 | 12/1981 | Japan . | |
| 63-242554 | 10/1988 | Japan . | |
| 1-145165 | 6/1989 | Japan . | |
| 3-215044 | 9/1991 | Japan | 347/92 |
| 5-077440 | 3/1993 | Japan . | |

*Primary Examiner*—N. Le
*Assistant Examiner*—Thien Tran
*Attorney, Agent, or Firm*—Michael T. Gabrik

[57] ABSTRACT

An ink jet recording apparatus and printer whereby air bubbles in the ink supply path are easily expelled even where a stagnation point or flow boundary is formed within the ink jet recording apparatus in which air bubbles tend to collect inside the ink supply path. Even when the air bubbles are not completely expelled, occlusion of the ink supply path by an air bubble is also prevented. In particular, the ink jet recording apparatus includes a capillary member which defines plural capillary paths disposed within the ink supply path upstream of the stagnation point or flow boundary occurring at the connection of the recording head to ink supply tube. These capillary paths are separated a distance away from the flow boundary and included angled walls and cross sections to enable fractionation of larger, potentially ink occluding bubbles.

15 Claims, 12 Drawing Sheets

INK JET RECORDING APPARATUS AND INK SUPPLY MEMBER THEREFOR

BACKGROUND OF THE INVENTION

1. Field of the Invention

The present invention relates generally to ink jet recording apparatuses which selectively emit ink droplets from a recording head onto a recording medium, and is particularly concerned with reducing or eliminating ink flow obstructions caused by air bubbles present in the ink supply path.

2. Description of the Related Art

Typically, an ink jet recording apparatus includes a recording head, an ink container for storing the ink, and one or more supply tubes connecting the ink container to the recording head, thereby forming an ink supply pathway.

The ink container is commonly a plastic case containing a rubber member or porous material. When the ink jet head is used over an extended period of time, the passage of air through the ink container results in a build-up of air bubbles therein, and some air bubbles may eventually flow into the ink supply tubes. Air bubbles can also be introduced to the ink supply pathway supply when the ink jet recording apparatus is subjected to sharp, sudden impacts such as when the ink jet recording apparatus or head itself is accidentally dropped or jarred.

In ink jet recording apparatuses utilizing replaceable ink containers, air bubbles can also be introduced to the ink supply tubes during container replacement. Bubbles can also arise when nitrogen present in the ink vaporizes due to a rise in ink temperature.

When such air bubbles occur, it is preferable to purge the bubbles from the recording head to prevent ink obstruction. This can be accomplished through a recovery device such as disclosed in U.S. Pat. No. 4,967,209 to Hasegawa, et al. As disclosed therein, the recovery device applies pressure to the back of the ink container with a needle-like member to momentarily increase pressure within the ink supply pathway and force expulsion of high viscosity ink near the nozzles or air bubbles within the recording head. This process is commonly referred to as a "priming operation." An alternate conventional recovery method involves covering the recording head nozzles with a cap and applying a vacuum pump connected to the cap to suction the air bubbles and surrounding ink from the recording head, thereby removing the air bubbles with almost equal effect.

With each of these conventional methods, however, there are cases in which the air bubbles inside the ink supply path cannot be removed. Air bubbles may remain in the ink supply path when a stagnation point (a point at which the ink flow is essentially zero even when negative or positive pressure is externally applied) is formed within the ink supply path. Air bubbles gather at this low flow site or stagnation point, and may not be completely removed even by the aforementioned priming process, unless a much greater volume of ink is removed as well.

An example of an ink supply path in which air bubbles tend to collect is described hereinbelow with reference to FIG. 16. FIG. 16 is a partial cross sectional view of a recording head 155 having an intake opening 158. Ink supply tube 153 conveys the ink stored in an ink storage well or tank (not shown) to the recording head, and includes supply opening 152 connecting to the ink receiving portion of recording head 155. After insertion of the ink receiving portion of recording head 155 within supply opening 152, the outside perimeter of the connection is sealed with an adhesive 159, to maintain the connection and form a closed supply path for supplying ink to nozzles (not shown) within the recording head 155.

As shown in FIG. 16, the ink supply path has, at the connection between the recording head 155 and ink supply tube 153, a flow boundary 151 in which the cross sectional area of the ink supply path changes abruptly. Relatively large air bubbles 168 tend to stop at this abrupt flow boundary 151. The contact area between the relatively large air bubble 168 and the side walls 200 of this ink supply path is also large. This large contact area increases the flow drag when the relatively large air bubble 168 attempts to move, and air bubbles capture here may not be sufficiently removed even through conventional priming. To completely remove such bubbles requires transport and emission of a relatively large quantity of ink. This in turn, significantly contributes to undesirable ink waste and collection problems.

Still referring to FIG. 16, when a relatively small air bubble 169 travels within the ink supply path, the smaller air bubble can be absorbed by the relatively large air bubble 168, and the relatively large air bubble 168 may thus grow even larger. In a worst case scenario, the air bubble may grow to cover the entire flow boundary 151 and thus obstruct intake opening 158. When this occurs, ink cannot be supplied to recording head 155, and printing operations cease.

In addition to ink supply paths defining an abrupt change in cross sectional areas as shown in FIG. 16, another type of ink supply path in which air bubbles tend to collect are ink supply paths in which a filter is interposed to prevent the inflow of foreign matter to the recording head. Relatively large air bubbles tend to gather in front of the filter, creating the same problems as described hereinabove.

A known approach for attenuating the occluding effects of these bubbles has been to alter the shape of the ink supply path immediately adjacent to the upstream side of the flow boundary. More specifically, as discussed in Japanese laid open patent application publication JP 05-077440, the ink supply path, which normally exhibits a circular cross section, is hollowed or squared out at the upstream edge of the flow boundary. As a result, this portion of the ink supply path exhibits a rectangular shape having a larger cross sectional area than the remaining circular portion of the ink supply path. Since bubbles collecting at the flow boundary grow spherically, the rectangular cross section of this portion of the ink supply path permits ink to flow in the corner grooves not occluded by a bubble present in the ink supply path.

However, in this structure, there is nothing to prevent the growth of bubbles at the flow boundary. When such a bubble becomes sufficiently large, it can still pinch off the ink flow through the corner grooves through sufficient expansion therein and/or occlusion of the entire orifice or orifices forming the downstream side of the flow boundary.

OBJECT OF THE INVENTION

Therefore, it is an object of the present invention to develop an ink jet recording apparatus and supply member whereby air bubbles present in the ink supply path can be expelled with relative ease, and even where air bubbles are not completely expelled, they are prevented from substantially obstructing the supply of ink to the recording head.

SUMMARY OF THE INVENTION

In accordance with this and related objects, an ink jet recording apparatus or supply member according to the present invention having at least one flow boundary at which the cross sectional area of the supply path decreases abruptly from the upstream side to the downstream side includes at least one capillary member having plural angled wall surfaces disposed substantially parallel to the ink flow direction inside the supply path upstream of the flow boundary. Further, the downstream ends of these walls are disposed a predetermined distance away from the flow boundary.

With the invention thus comprised, a capillary member comprising plural angled wall surfaces is disposed substantially parallel to the direction of ink flow inside the supply path on the upstream side of the flow boundary at which air bubbles tend to collect. As a result, air bubbles inside the ink supply path are fractionated as they pass through capillary paths formed by the capillary member when the ink inside the ink supply path is suctioned or pressurized by through recovery (priming) techniques. The fractionated air bubbles can thus flow more easily to the downstream side of the flow boundary and can thus be more reliably purged.

In addition, spacing the downstream edges of the wall surfaces of the capillary member some predetermined distance away from the flow boundary ensures adequate ink flow even in the presence of bubbles within capillary paths formed by the aforementioned capillary member wall surfaces. Even when a bubble inside the capillary path grows spherically to a maximum diameter accommodated by the path, the aforementioned distance prevents the bubble from pinching off ink flow in the angled groove portions of the capillary path as well as preventing it from completely occluding the ink inlet port of a recording head or similar orifice forming the downstream edge of the flow boundary.

It is preferable for the cross section of the capillary paths formed by the capillary member to be triangular, rectangular, or otherwise exhibit a non-circular cross section. By providing at least one angle, air bubbles that may grow inside the capillary paths are prevented from completely occupying the path, and ink flow may be maintained by one or more grooves in the path circumscribing the spherical bubble. Because the downstream ends of the wall surfaces of the capillary member which form the capillary paths are disposed at a particular distance from the flow boundary, forming noncircular capillary paths makes it especially difficult for air bubbles to occupy the space between these ends and the flow boundary. As a result, ink is supplied from the angled portion of the capillary paths passes through the downstream ends of the wall surfaces forming the capillary paths and through the flow boundary even if an air bubble stops inside the capillary paths.

It is further preferable that the distance separating the downstream end of the wall members from the flow boundary of the ink supply path range from 0.05 mm −0.5 mm. When the separation distance is maintained within this range, the supply of ink to the recording head can be assured even if air bubbles are present in the capillary portion of the ink supply path.

In the preferred embodiment of the invention, the angled shapes for the capillary path can be achieved by disposing comb-like or grid-like capillary members upstream of the flow boundary, and forming the capillary path from the wall surfaces of these members. Alternatively, these capillary paths may be formed through introducing a porous plate having plural through-holes into the ink supply path upstream of the flow boundary. In each case, however, the cross section of the capillary path thus formed must be non-circular in order to effectively fractionate encountered air bubbles.

Air bubbles particularly tend to stop in the ink supply path when an opening with a rectangular cross section defining the flow boundary is disposed in one part of the ink supply path. Expulsion of the air bubbles is made easier, however, by disposing a comb-shaped capillary member or members substantially perpendicular to the major axis of the rectangular opening.

The locations where these capillary paths are most effective are upstream of the flow boundary formed where the ink inlet port of the recording head and the ink intake of the supply tube connect, and upstream of the flow boundary formed by the flat surface of a filter preventing foreign matter from flowing downstream.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

Figure 1:
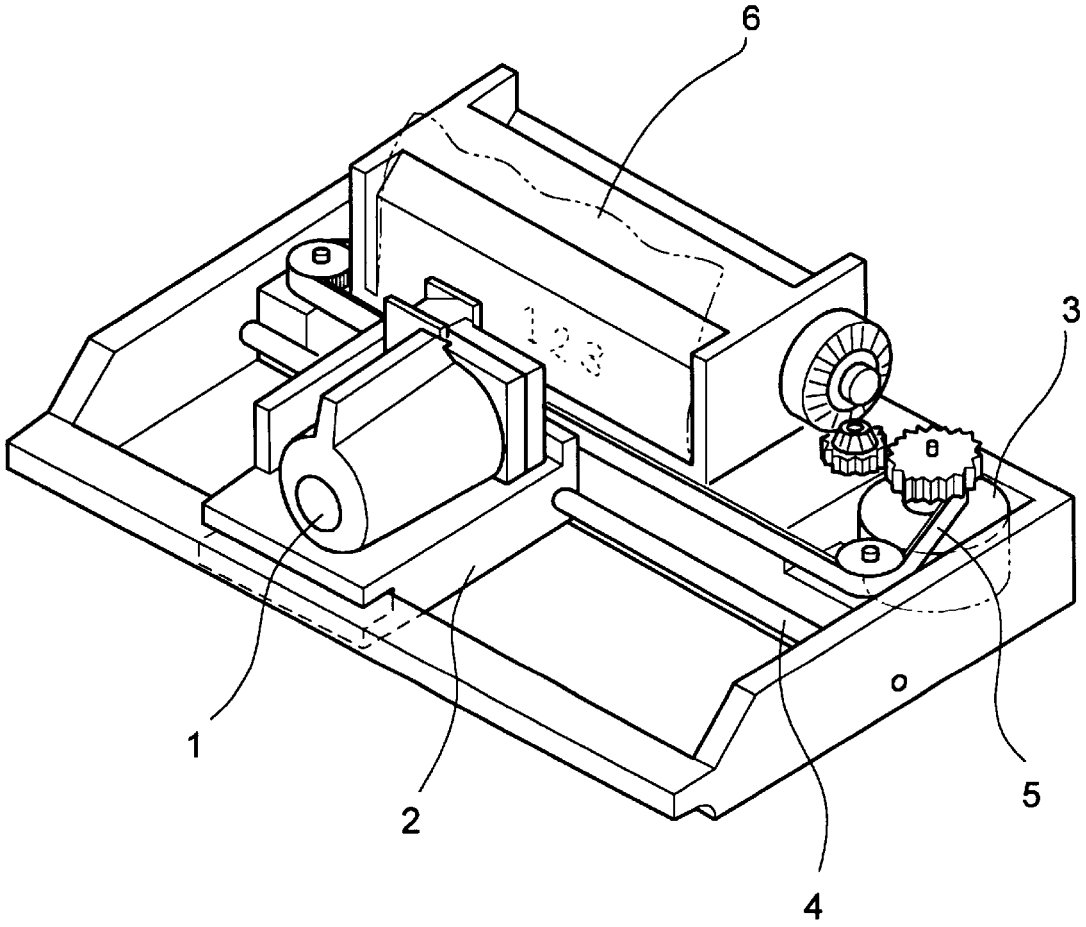
FIG. 1 is a perspective view of an ink jet printer in which the present invention is applied.

FIG. 1 presents an overview of an ink jet printer applying the present invention. In this ink jet printer, ink jet cartridge 1 is mounted on carriage 2, and driven in the recording direction of the recording medium 6 by motor 3 via belt 5 with carriage 2 engaging guide rail 4.

Figure 2:
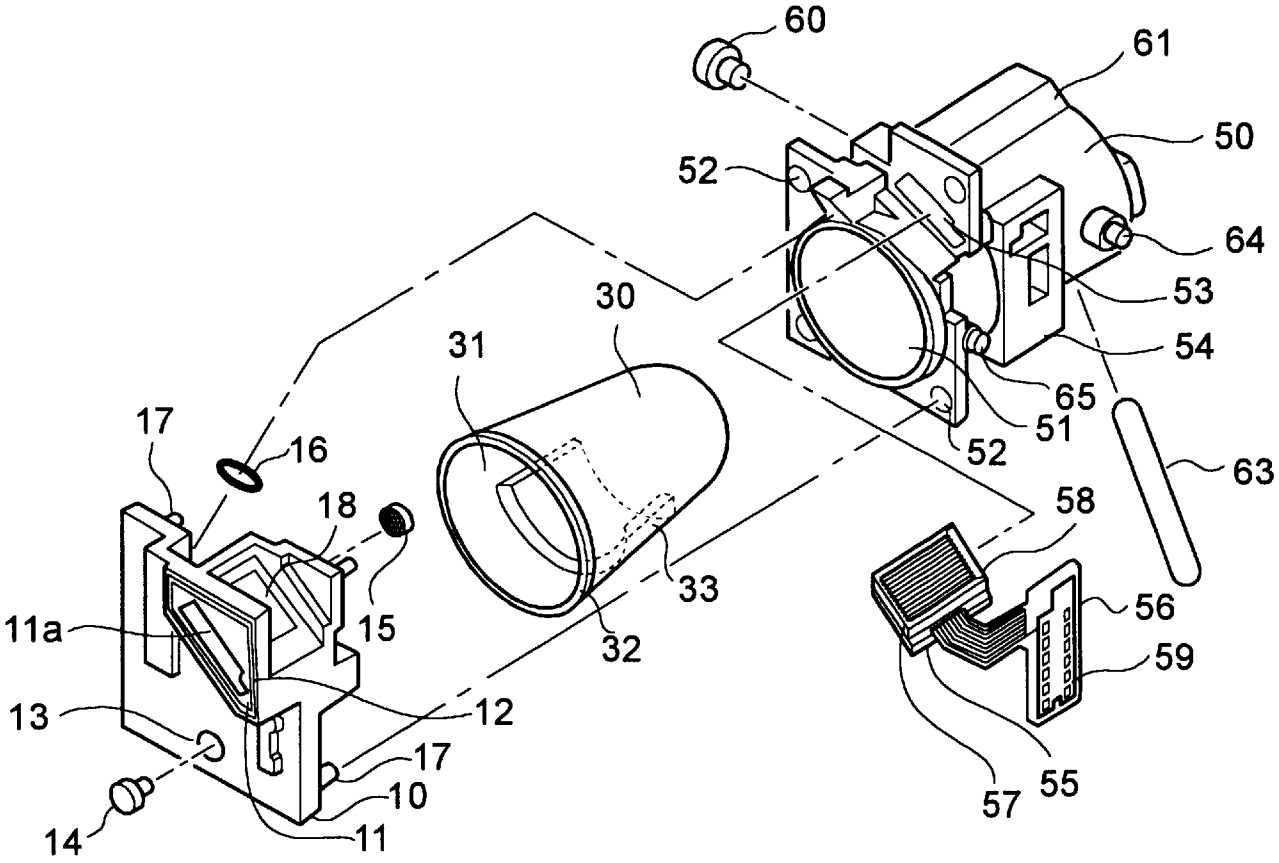
FIG. 2 is a partially exploded perspective view of the ink jet cartridge shown in FIG. 1.

FIG. 2 is a partially exploded overview of ink jet cartridge 1 shown in FIG. 1. Here, ink jet cartridge 1 comprises head case 10, ink sack 30, and ink supply case 50. Head case 10 is preferably made from polyacrylate (PAR), polysulfone (PSF), polycarbonate (PC), or similar transparent material.

Nozzle plate 11 having an opening 11*a* in which nozzles 57 appear when head chip 55 described hereinbelow is mounted therein is provided at the right front shoulder of head case 10. Ink-stopping channel 12 is provided around nozzle plate 11.

When priming is executed, ink-stopping channel 12 stops the ink ejected from nozzles 57 using the surface tension of the ink, and the expelled ink adheres to the inside of the channel due to the surface tension of the ink. The capacity of the ink-stopping channel 12 is therefore a guide to the volume of ink expelled (consumed) by the priming process. This volume can also be used to prevent ink waste resulting from excessive priming through repeated priming processes, and to prevent nonrecoverable problems (including non-expulsion of high viscosity ink or air bubbles in a nozzle) caused by insufficient priming.

An ink injection opening 13 is disposed at the bottom front of head case 10, and is plugged by plug 14 except when ink sack 30 is being filled with ink. Measures, such as manufacturing plug 14 from nylon, are taken to prevent foreign matter from entering when plug 14 is pressed into place, but it should be noted that plug 14 can also be manufactured from polyamide or other soft resin or a ball bearing-like member. These techniques of manufacturing plug 14 and preventing penetration of foreign matter can be also used with plug 60 inserted to ink supply case 50 as described hereinbelow.

As further described hereinbelow specifically with reference to FIG. 4, an ink supply tube 66 is formed on the back of head case 10. A filter 15 is heat-fused to the intake part of this ink supply tube. In this embodiment, Filter 15 is a twill-weave stainless steel mesh screen. The ink supply tube formed on the back of head case 10 and the ink supply tube formed on ink supply case 50 are connected using an O-ring 16. O-ring 16 is disposed between head case 10 and ink supply case 50, and thus forms part of the ink supply tube.

Referring back to FIG. 1, plural pins 17 are also disposed on the back of head case 10 for coupling with ink supply case 50.

Ink sack 30 is preferably manufactured from a butyl rubber material. The open end 31 of ink sack 30 is substantially circular as shown in FIG. 2, and includes packing material 32 around the perimeter. Packing material 32 is held between head case 10 and ink supply case 50, thereby forming a seal, in a shape that is long and flat or elliptical in the direction parallel to carriage movement. A thick-wall member 33 is also disposed at the bottom of ink sack 30.

Ink supply case 50 is also manufactured from polyacrylate (PAR), polysulfone (PSF), polycarbonate (PC), or transparent material similarly to head case 10. Opening 51 is provided on the end of ink supply case 50 opposite head case 10, and ink sack 30 is housed inside ink supply case 50 through opening 51. Engaging holes 52 are also formed for coupling ink supply case 50 and head case 10 by press-fitting pins 17 of head case 10 into engaging holes 52.

An opening 53 shaped identical to opening 11*a* in nozzle plate 11 of head case 10 is also formed in the side of ink supply case 50 opposite head case 10. Head FPC ("Flexible Printed Circuit") holder 54 for holding a flexible printed circuit is also formed in the side of ink supply case 50. Recording head chip 55 is secured in opening 53, and head FPC 56 is held in head FPC holder 54.

Plural nozzles 57 are arrayed at equal intervals at the distal end of head chip 55. Ink inlet port 58 is disposed at the other end of head chip 55. Ink inlet port 58 has a roughly rectangular, long, narrow cross section oriented substantially parallel to the nozzle array.

Recording head chip 55 is inserted in space 18 formed on the back of head case 10. Nozzles 57 are inserted to opening 11*a* of nozzle plate 11 on head case 10, and are fixed in place with adhesive applied around the perimeter of the nozzle block. Ink inlet port 58 is inserted within opening 53, which thus functions as the ink supply opening in ink supply case 50, and the perimeter is sealed and fixed with an adhesive. Head FPC 56 is preferably made from polyimide with continuity to recording head chip 55 established by an anistropic conductive film. Contacts 59 are fixed to head FPC holder 54 of ink supply case 50 using, for example, double-sided tape.

An opening (not shown in the figures) is also provided on the opposite side of head FPC holder 54 in ink supply case 50. This opening is plugged by plug 60. A protruding handle 61 is also provided on the top side of ink supply case 50. A through-hole (not shown in the figures) is provided on the bottom of ink supply case 50, and pressure rod 63 is inserted to this hole. Pressure rod 63 is used to press thick-wall member 33 of ink sack 30 at printer initialization before printing starts and when printing problems develop to apply pressure to the ink inside ink sack 30.

Positioning pins 64 and 65 for positioning to the carriage (not shown in the figures) are also disposed in the head FPC holder 54 side of ink supply case 50. When the ink jet recording apparatus is mounted to the carriage, these positioning pins 64 and 65 provide a reference position for the installation.

As thus described above, the ink jet recording apparatus according to the present invention is comprised of basically transparent components, thereby enabling the operator to see inside, estimate the remaining ink capacity of the ink sack, and determine whether printing is possible before printing starts.

Figure 5:
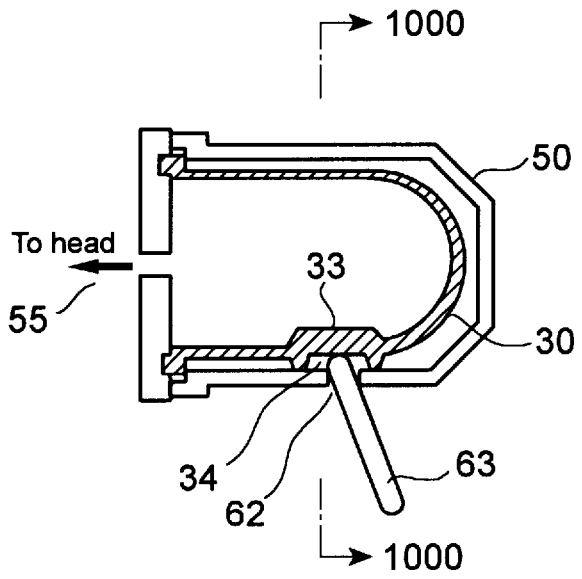
FIG. 5 is a simplified horizontal cross section of the ink jet cartridge shown in FIG. 2.
Figure 6:
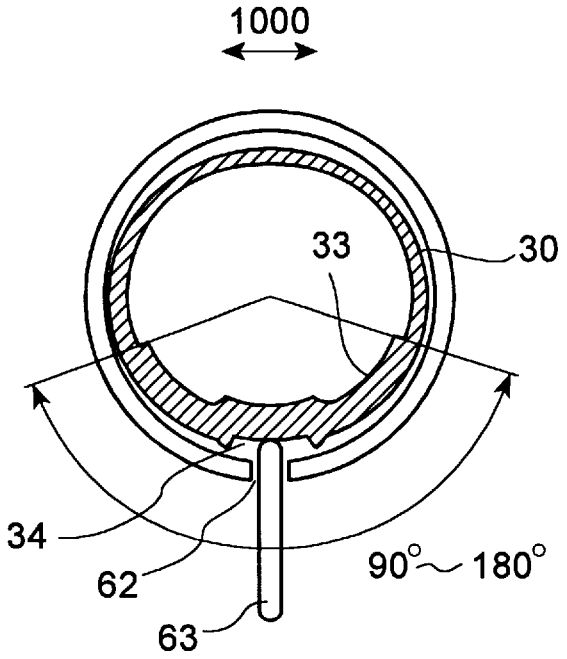
FIG. 6 is a simplified vertical cross section of the ink jet cartridge taken along line 1000 as shown in FIG. 5.

FIG. 5 is a horizontal cross section of ink sack 30 in the ink jet cartridge shown in FIG. 2, and FIG. 6 is a vertical cross section of ink sack 30 through line 1000 in FIG. 5. As shown in these figures, thick-wall member 33 of ink sack 30 against which pressure rod 63 presses covers approximately one-third of the length of ink sack 30 at approximately the bottom center thereof, and covers a circumferential arc of between 90 degrees and 180 degrees. Thick-wall member 33 is approximately 1–3 mm thick while the thin-wall part of ink sack 30 is approximately 0.3–0.5 mm thick. Guide member 34 is also disposed to thick-wall member 33 to assure that pressure rod 63 presses against thick-wall member 33 for the priming process. Note, further, that the thickness of thick-wall member 33 is to the inside of ink sack 30. The gap between thick-wall member 33 and ink supply case 50 is preferably as small as possible. Ink sack 30 is also a flattened shape with the long dimension oriented in the direction of movement B of the carriage, and deformation from the priming operation with pressure rod 63 works with thick-wall member 33 to achieve a constant deformation.

Figure 3:
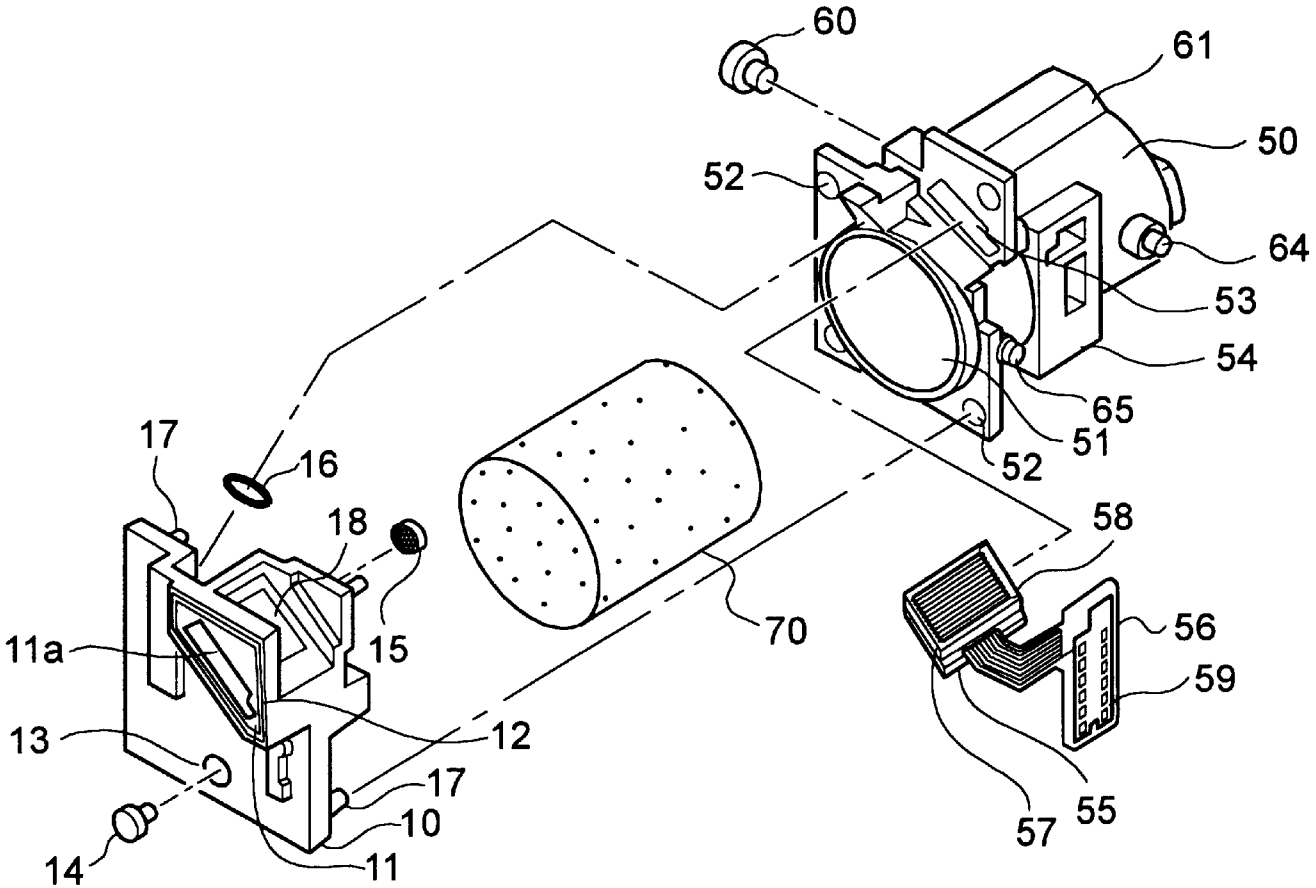
FIG. 3 is a partially exploded overview of an alternative embodiment of the ink jet cartridge shown in FIG. 2.

FIG. 3 is a partially exploded overview of an alternative embodiment of ink jet cartridge 1 shown in FIG. 1. In this embodiment the ink holding member is made from a porous material. The ink jet cartridge shown in FIG. 3 is identical to that shown in FIG. 2 except for the structure of the ink holding member. Further description of the parts other than the ink holding member is therefore omitted hereinbelow.

Porous material 70 may be, for example, a urethane foam material having many fine pores and used as an absorber that is impregnated with ink. Porous material 70 is housed inside opening 51 of ink supply case 50. An ink jet cartridge thus comprising a porous material as the ink holding member cannot be primed (refreshed) by pressurizing with a pressure rod 63 as described in the preceding embodiment. As a result, this type of ink jet cartridge is primed using a method as described below.

The priming technique of this ink jet cartridge and recording apparatus uses a cap (not shown in the figures) covering nozzles 57 of head chip 55 and a suction device (not shown in the figures) such as a liquid pump connected to the cap disposed above motor 3 of the ink jet printer shown in FIG. 1. When nozzles 57 are capped, the suction means suctions the nozzles 57 inside the cap to suction out any high viscosity ink around the nozzles or air bubbles inside the ink supply path.

Figure 4:
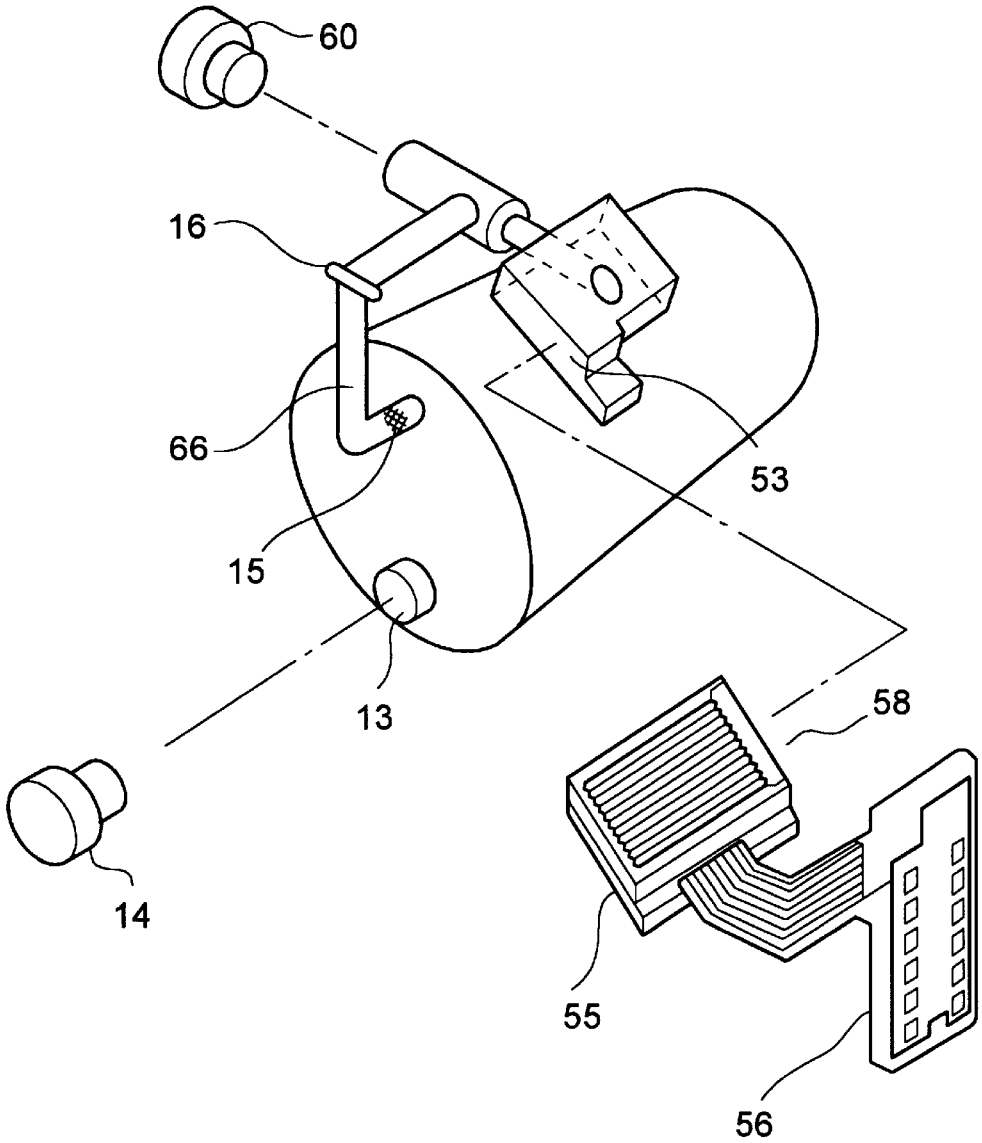
FIG. 4 is a partially exploded overview of the ink supply path of the ink jet cartridges shown in FIG. 2 and FIG. 3.

FIG. 4 is an overview of particularly the ink supply tube of the ink jet cartridges shown in FIG. 2 and FIG. 3. As shown in FIG. 4, ink supply tube 66 is formed to head case 10 and ink supply case 50 covering ink sack 30. The capillary path that is a feature of the present invention is disposed in the opening (ink supply opening) 53 of ink supply case 50 where ink supply tube 66 is connected to ink inlet port 58 of head chip 55.

A preferred embodiment of the capillary member of the invention is now described with reference to FIGS. 7 to 10, 17A and 17B.

Figure 7:
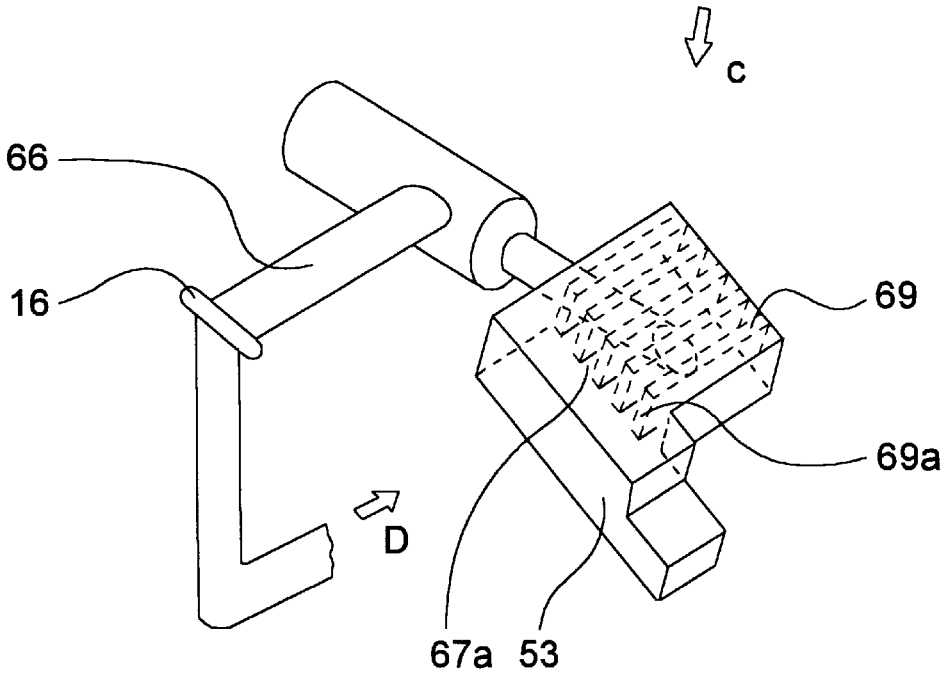
FIG. 7 is a perspective view of the capillary member portion of the ink supply path according to the preferred embodiment of the invention.
Figure 8:
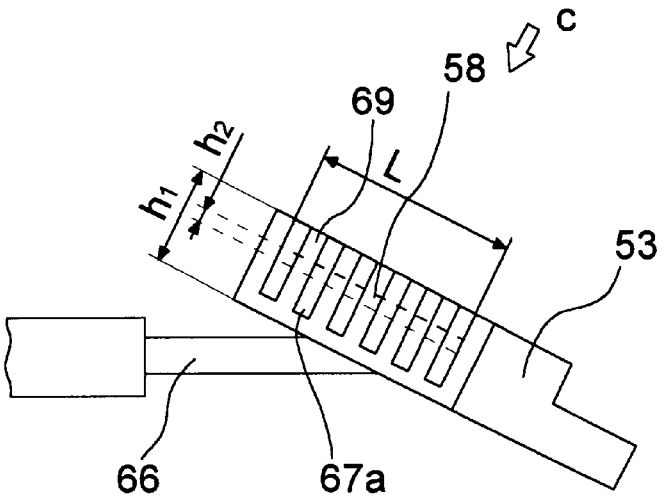
FIG. 8 is a plan view of the capillary member portion of FIG. 7 taken from the direction of arrow D.
Figure 9:
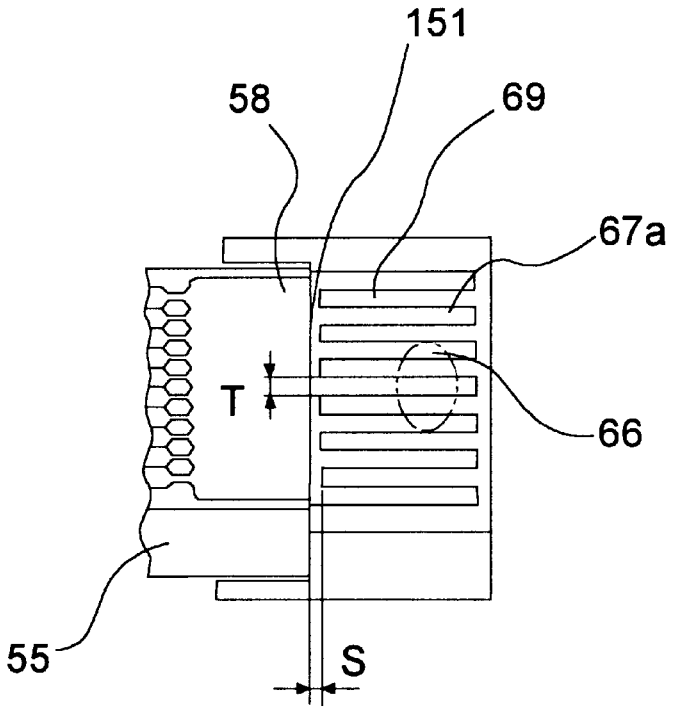
FIG. 9 is a cutaway plan view of the capillary member portion of FIG. 7 taken from the direction of arrow C and illustrating the connection between the recording head and the capillary paths.

FIG. 7 is an overview of the capillary member portion of the ink supply path in a preferred embodiment of the invention. FIG. 8 is a plan view of the capillary members from the direction of arrow D in FIG. 7, i.e., from the ink inlet port of the head chip. FIG. 9 is a plan view of the capillary members from the direction of arrow C in FIG. 7 illustrating the connection between the head chip and capillary path.

As shown by dashed lines in FIG. 8, the shape of ink inlet port 58 of head chip 55 (not shown in FIG. 8) is substantially rectangular with width L greater than height h2. Height h1 of the opening on the ink supply case 50 side connecting to ink inlet port 58 is significantly greater than height h2 of ink inlet port 58, thus creating a flow boundary 151 at the junction between the recording head chip 55 and the ink supply path. As discussed hereinabove, such a flow boundary 151 in the ink supply path may encourage large air bubbles to collect immediately upstream thereof.

Still referring to FIGS. 7 and 8, upstream from opening 53 in ink supply case 50 are disposed plural long, narrow capillary members 69 in a row-like manner. These capillary members 69 are positioned to be roughly perpendicular to the major axis of the rectangular ink inlet port 58 of the recording head chip 55 when the head chip 55 is inserted within opening 53. The ends 69*a* of these capillary members 69 are positioned at a specific distance S from the end (flow boundary 151) of ink inlet port 58 when the head chip 55 is inserted into opening 53. As a result, a series of very narrow flow channels (capillary paths) 67*a* (width T, height h1) forming a comb-like pattern of ink flow channels are positioned upstream from this flow boundary 151.

Figure 17A:
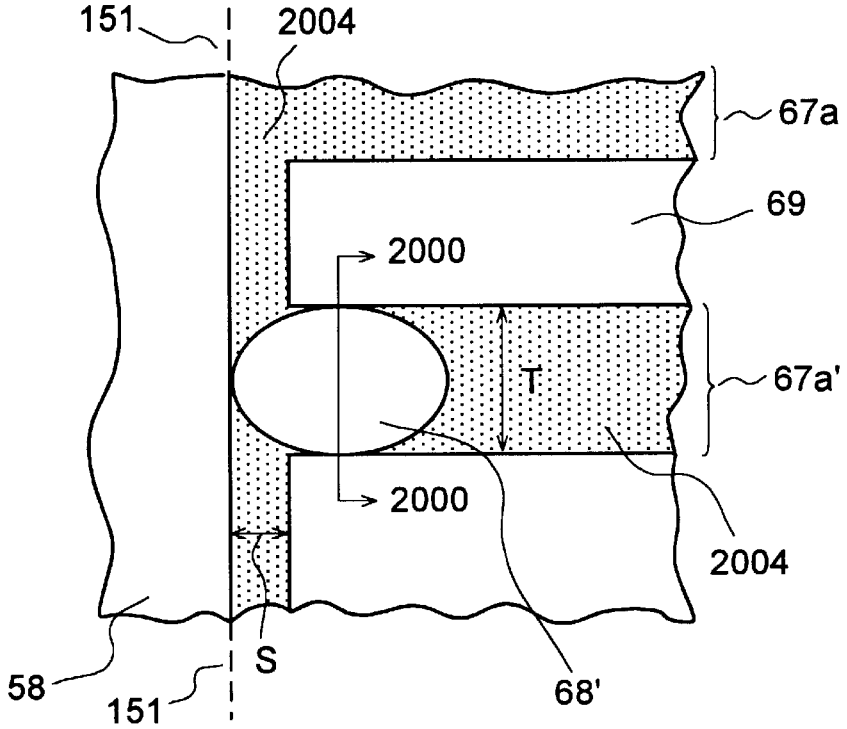
FIGS. 17A and 17B are more detailed plan and horizontal cross sectional views respectively of the capillary member portion of FIG. 9.
Figure 17B:
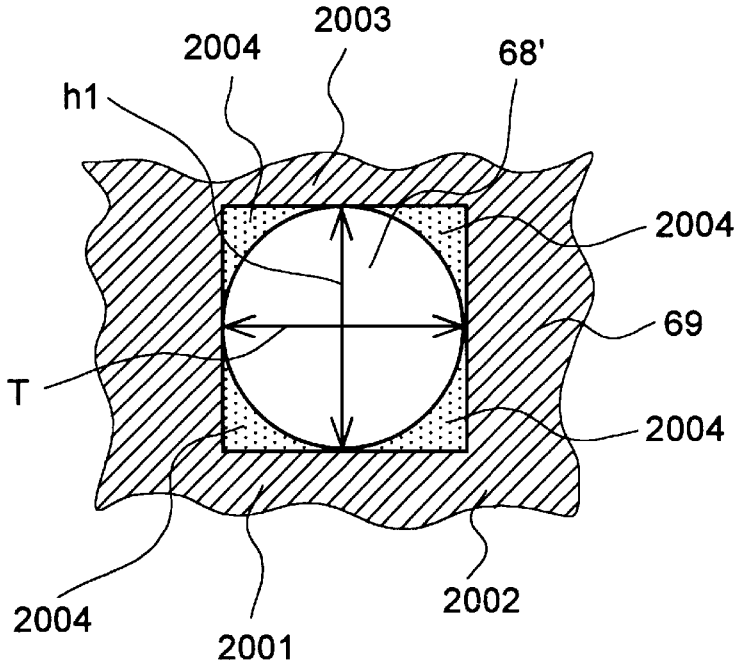

Preferably, as shown in FIG. 17B, capillary members 69 are formed integrally with case 50 of ink supply tube 66 which is made from polyacrylate (PAR), polysulfone(PSF), polycarbonate(PC), or similar translucent material.

Figure 10:
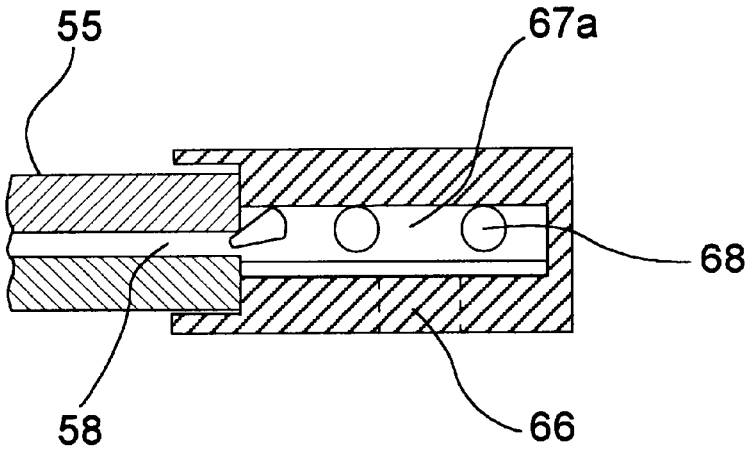
FIG. 10 is a simplified vertical cross section of the capillary member portion of FIG. 7 illustrating air bubble expulsion according to the preferred embodiment.

FIG. 10 is a vertical cross section of the head chip 55—opening 53*a* junction (flow boundary area 151) used to describe air bubble expulsion in this embodiment of the invention. Air bubbles 68 inside ink supply tube 66 flow towards head chip 55 by the aforementioned priming or suction operations, and are fractionated within capillary paths (flow channels) 67*a* by capillary members 69 (FIG. 7). The inflow resistance to ink inlet port 58 is thereby reduced, the ink therefore flows in easily, and air bubbles can be reliably purged.

FIGS. 17A and 17B are additional detailed plan and horizontal cross sectional views of the capillary path portion of the ink supply path of the preferred embodiment, and are particularly helpful in describing ink flow movement through a given capillary path when a bubble grows to substantially occlude it. In FIG. 17A, roughly spherical bubble 68', having a diameter substantially equal to width T, is shown substantially occluding capillary path 67*a*'. Ink 2004 within the ink supply path is denoted here and FIG. 17B by the lightly stippled areas shown therein.

Since capillary path 67*a*', like other capillary paths 67 exhibit a noncircular cross section perpendicular to the flow of ink, capillary channels 2001 formed between the corners or joints of the capillary member 69 wall surfaces to the upper (2003) and lower (2004) interior surfaces of the ink supply tube 66 permit the flow of ink 2004 therethrough despite occluding bubble 68'. Moreover, since the capillary members 69 are spaced at least gap S from the flow boundary and ink inlet port 58, the bubble confined by the capillary member 69 cannot grow to completely occlude the rectangular orifice of recording head ink inlet port 58 forming the flow boundary 151.

In tests conducted with a recording head having an ink inlet port with width L of 4.5 mm and height h2 of 0.087 mm, and six capillary paths with a height hl of 0.84 mm and width T of 0.3 mm disposed at a distance S of 0.15 mm from the flow boundary, good results were achieved. Specifically, with an ink supply tube not incorporating these capillary members, large air bubbles stop at the flow boundary and cannot be sufficiently expelled even with the priming process. Using the capillary members described above in connection with the presently preferred embodiment, however, air bubbles can be expelled with relative ease.

It is also of course possible with an ink supply tube not having these capillary members for an air bubble therein to grow large enough to completely block the ink inlet port, thus preventing ink from being supplied to the recording head and preventing printing from proceeding. With the ink supply tube comprising capillary members according to the preferred embodiment, however, ink supply to the recording head is not stopped even if an air bubble grows.

Note that tests by Applicants have shown that blockage of the ink supply to the recording head does not occur when the distance from the flow boundary to the downstream edge of the capillary member ranges anywhere from 0.05 mm to 0.5 mm.

Figure 11:
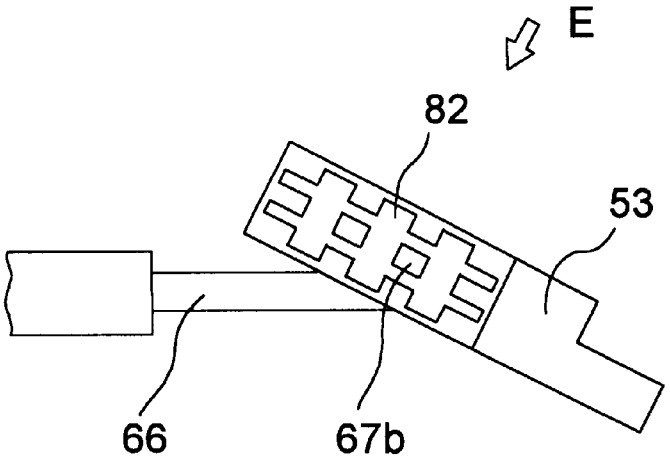
FIG. 11 is a plan view of a capillary member portion of the ink supply path according to a first alternative embodiment of the invention, as taken from the ink inlet port of the recording head.
Figure 12:
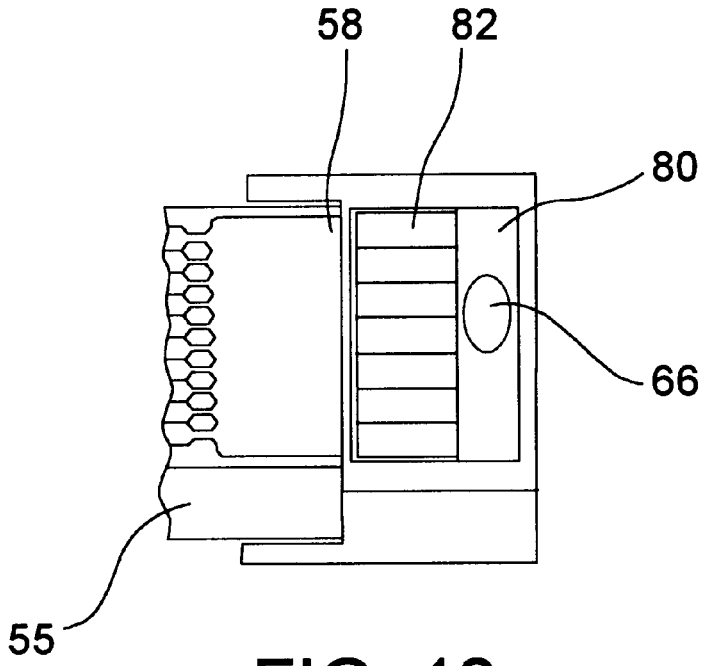
FIG. 12 is a cutaway plan view of the capillary member portion of FIG. 11 taken from the direction of arrow E and illustrating the connection between the recording head and capillary paths.

FIG. 11 is a plan view showing the shape of the capillary member in a first alternative embodiment of the invention, taken from the ink inlet port side of the head chip. FIG. 12 is a top view (from the direction of arrow E in FIG. 11) of the connection between the head chip and capillary paths in the embodiment shown in FIG. 11.

In this embodiment, grid member 82 is made from polysulfone (PSF) or other plastic material resistant to ink. Grid member 82 has numerous, extremely narrow holes divided by the grid lattice, and is housed in case reservoir 80. Note that grid member 82 need not be limited to a plastic material, and can be made from stainless steel or other metal. It is sufficient if such a grid member divides the inside of case reservoir 80 into a grid pattern interrupting the direction of ink flow from ink supply tube 66 to ink inlet port 58 of recording head chip 55. Air bubbles inside ink supply tube 66 flow toward head chip 55 through the aforementioned priming or suction operations and fractionated by grid member 82. This reduces the flow resistance into ink inlet port 58, enables reliable purging of air bubbles, and thus enables reliable priming and recovery as in the case of the preferred embodiment described hereinabove.

Figure 13:
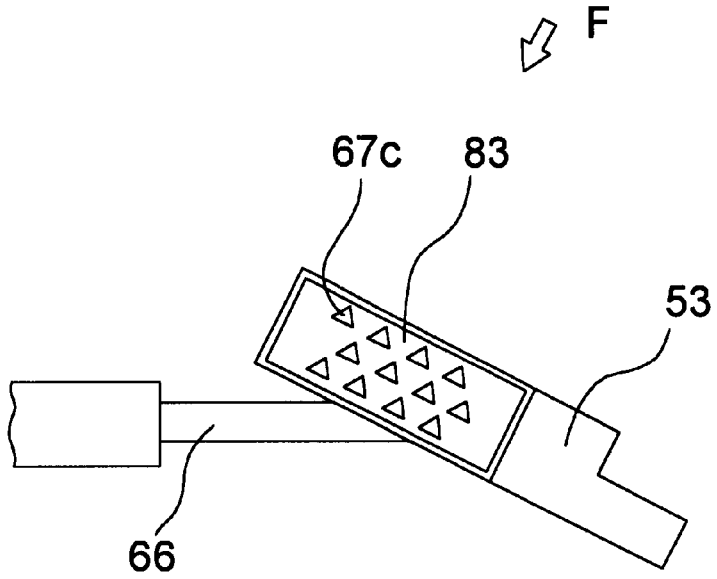
FIG. 13 is a plan view of a capillary member portion of the ink supply pathway according to a second alternative embodiment of the invention, as taken from the ink inlet port of the recording head.
Figure 14:
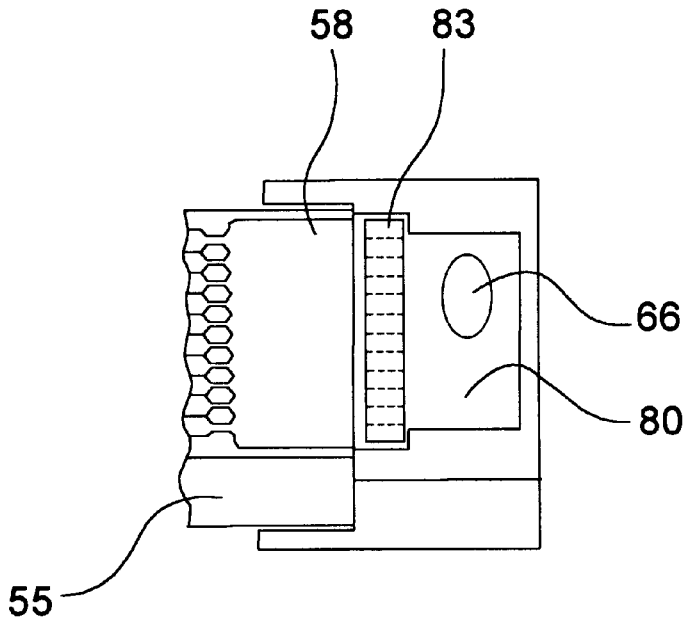
FIG. 14 is a cutaway plan view of the capillary member portion of FIG. 13 taken from the direction of arrow F and illustrating the connection between the recording head and capillary paths.

FIG. 13 is a plan view showing the shape of the capillary member according to a second alternative embodiment of the invention, again taken from the ink inlet port side of the head chip. FIG. 14 is a top view (from the direction of arrow F in FIG. 13) of the connection between the head chip and capillary paths in the embodiment shown in FIG. 13.

Porous plate 83 serving as the capillary member is preferably made from stainless steel or other metallic material resistant to ink, but can also be made from polysulfone (PSF) or other material resistant to ink, as described hereinabove in connection with the first alternative embodiment of the invention. Capillary paths 67*c* are formed from plural through-holes in porous plate 83, which is housed in case reservoir 80.

Ink is supplied to case reservoir 80 by ink supply tube 66. Capillary paths 67*c* have a triangular cross section. As a result, air bubbles that penetrate a capillary path 67*c* are prevented from completely occluding the capillary path. Note that the cross section of these capillary paths 67*c* need not be limited to having a triangular cross section and can be any shape that keeps spherical air bubbles from contacting all wall surfaces of the capillary paths.

Figure 15:
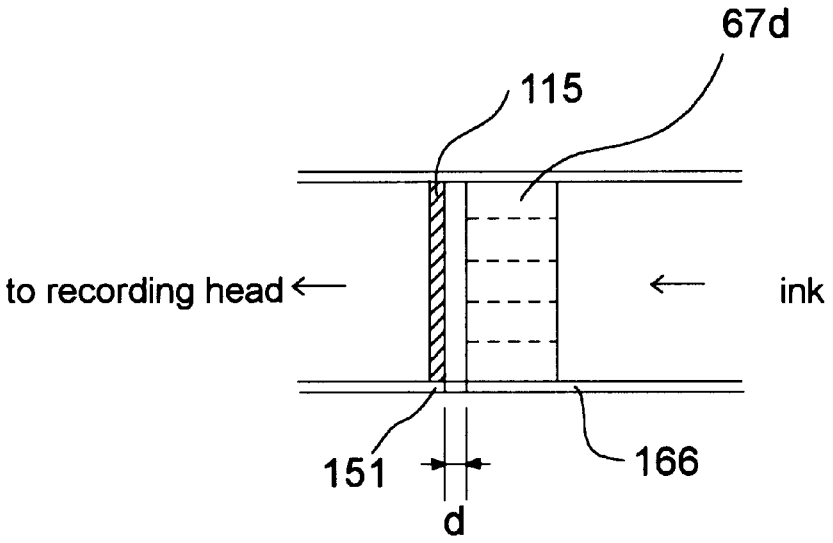
FIG. 15 is a cross section of the capillary member according to a third alternative embodiment of the invention.
Figure 16:
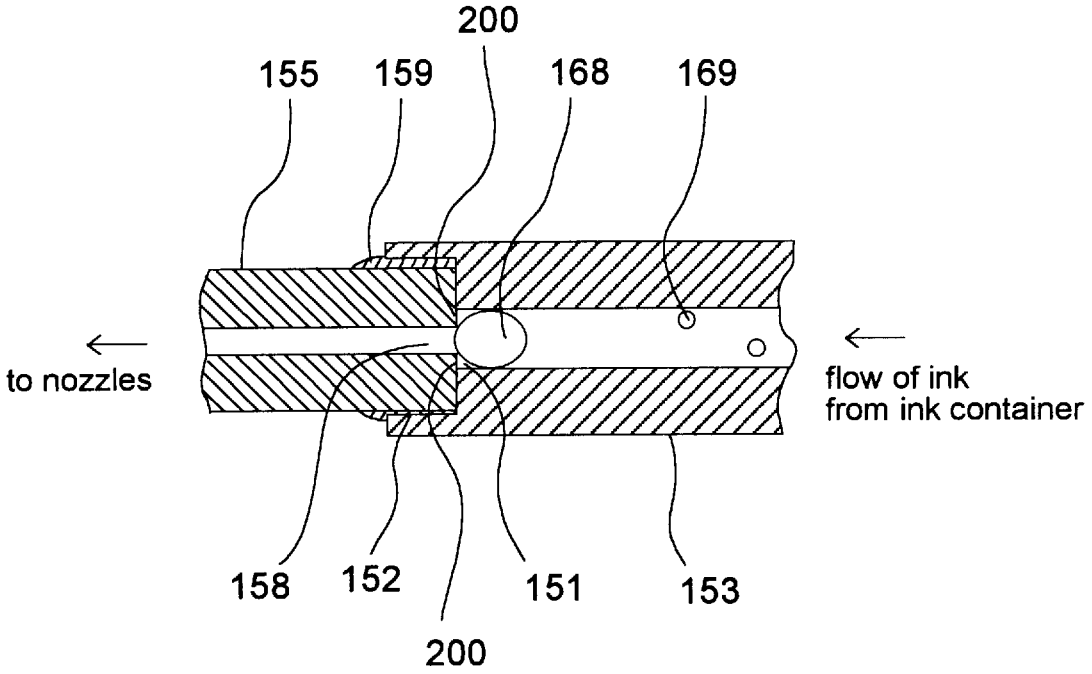
FIG. 16 (Prior Art)
FIG. 16 is a cross section of the flow boundary of a conventional ink supply path.

FIG. 15 is a cross section of the capillary member according to a third alternative embodiment of the invention. Note that both capillary paths 67*d* and filter 115 for preventing foreign matter from flowing downstream are disposed inside ink supply tube 166.

Filter 115 is an extremely fine mesh filter provided to prevent foreign matter capable of clogging the nozzles, which have the smallest cross sectional area of any part of the ink supply path. As a result, even relatively small air bubbles flowing downstream are stopped at the filter face, grow into relatively large air bubbles as more bubbles continue to flow, and can be difficult to purge even with the recovery operation. It is also possible for the air bubbles to completely occlude the ink supply path, thereby making it difficult to supply ink downstream.

More specifically, a flow boundary 151 at which air bubbles tend to collect is also formed in front of filter 115 disposed inside the ink supply tube. By forming capillary paths 67*d* at a specified distance *d* upstream from flow boundary 151, the above-described effect of improving air bubble expulsion is achieved, and occlusion of the ink supply path by air bubbles collecting and growing can be prevented.

It should be noted that the capillary paths 67*d* in this embodiment can be shaped identically to those in any of the previously described embodiments. In addition, other shapes can also be used insofar as the shape of the capillary paths is appropriately determined according to the cross sectional shape of the ink supply tube.

It will also be obvious that the invention shall not be limited to the embodiments described above, and various other alternatives are possible.

For example, the above embodiments have been described with reference to an ink cartridge internally comprising a recording head and ink supply unit. As will be appreciated by those ordinarily skilled in the art, the invention need not be so limited, however, and can be applied, for example, with the recording head and ink supply unit separately configured with the capillary member(s) of the invention disposed in the ink supply tube connecting the recording head and ink supply unit.

Furthermore, while the above embodiments have been described with reference to a method of pressurizing the ink storage tank to expel air bubbles, the invention need not be so limited. Other conventional recovery techniques can be alternatively used, including, for example, a suction pump and cap to suction ink in the recording head out from the nozzles. A pressurizing mechanism can also be disposed between the ink storage tank and capillary members to expel ink in the recording head from the nozzles.

By forming a capillary member proximate the ink inlet port of the recording head, the present invention can provide for efficient expelling of air bubbles inside the ink supply tube, and can thereby reliably refresh the nozzles and recover printing.

The invention also provides for minimizing the amount of ink that is also expelled when expelling air bubbles.

Furthermore, even when air bubbles are not completely expelled, occlusion of the ink supply tubes by growing air bubbles is prevented, and interruption of the ink supply to the recording head by such air bubbles can be reliably prevented.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. An ink jet recording apparatus, comprising:

an ink storage member for storing ink, a recording head including a nozzle for expelling ink droplets, an ink supply member connecting said recording head to said ink storage member, an ink flow path between said ink storage member and said nozzle and a flow boundary plane formed where a cross-sectional area of the ink flow path on an upstream side of said flow boundary plane is greater than said cross-sectional area of said ink flow path on a downstream side of said flow boundary plane, a capillary member dividing a cross-sectional area of said ink supply member into a plurality of separate substantially parallel channels each having an inlet and an outlet, each inlet of said channels located on an ink storage member side of said ink supply member and each outlet of said channels located on a recording head side of said ink supply member, said channels extending substantially perpendicular to said flow boundary plane, and said capillary member being disposed on said upstream side of said flow boundary plane, and a gap formed between said capillary member and said flow boundary plane so that a downstream end of said channels is spaced apart from said flow boundary plane by a predetermined distance, whereby bubbles present in the ink are fractionated by said capillary member and dispersed for ejection with said ink through said recording head.

2. The ink jet recording apparatus of claim 1, wherein the predetermined distance ranges from 0.05 mm to 0.5 mm.

3. The ink jet recording apparatus of claim 1, wherein said capillary member comprises a plurality of spatially separated comb-like members defining the plurality of separate substantially parallel channels in said ink supply member.

4. The ink jet recording apparatus of claim 3, wherein said recording head includes an ink inlet port having a rectangular opening.

5. The ink jet recording apparatus of claim 1, wherein said capillary member comprises a porous member defining the plurality of separate substantially parallel channels in said ink supply member, each of the channels exhibiting a noncircular cross-section.

6. The ink jet recording apparatus of claim 1, further comprising a pressurizing mechanism disposed between said ink storage member and said capillary member for forcibly expelling the ink through said nozzle.

7. The ink jet recording apparatus of claim 1, further comprising a suction mechanism in releasable communication with said nozzle for suctioning the ink within said recording head and said ink supply member through said nozzle.

8. The ink jet recording apparatus of claim 1, wherein said recording head, said ink storage member, and said ink supply member are commonly housed within an ink cartridge.

9. The ink jet recording apparatus of claim 8, further comprising a pressurizing mechanism disposed within said cartridge for pressurizing the ink storage member.

10. The ink jet recording apparatus of claim 1, further comprising a filter disposed within said ink flow path for catching foreign matter in the ink, said filter including a porous surface which defines the flow boundary plane.

11. An ink supply member through which ink is transferred from an ink storage member to a recording head having a nozzle for expelling ink droplets, comprising:

an ink flow path between said ink storage member and said nozzle and a flow boundary plane formed where a cross-sectional area of the ink flow path on an upstream side of said flow boundary plane is greater than said cross-sectional area of said ink flow path on a downstream side of said flow boundary plane, a capillary member dividing a cross-sectional area of said ink supply member into a plurality of separate substantially parallel channels each having an inlet and an outlet, each inlet of said channels located on an ink storage member side of said ink supply member and each outlet of said channels located on a nozzle side of said ink supply member, said channels extending substantially perpendicular to said flow boundary plane, and said capillary member being disposed on said upstream side of said flow boundary plane, and a gap formed between said capillary member and said flow boundary plane so that a downstream end of said channels is spaced apart from said flow boundary plane by a predetermined distance, whereby bubbles present in the ink are fractionated and dispersed for ejection with said ink through said recording head.

12. The ink supply member of claim 11, wherein the predetermined distance ranges from 0.05 mm to 0.5 mm.

13. The ink supply member of claim 11, wherein said capillary member comprises a plurality of spatially separated comb-like members defining the plurality of separate substantially parallel channels in said ink supply member.

14. The ink supply member of claim 11, wherein said capillary member comprises a porous member defining the plurality of separate substantially parallel channels in said ink supply member, each of the channels exhibiting a noncircular cross-section.

15. The ink supply member of claim 11, further comprising a filter disposed within said ink flow path for catching foreign matter in the ink, said filter including a porous surface which defines the flow boundary plane.

* * * * *